US009416566B2

(12) United States Patent
Tomaszewski et al.

(10) Patent No.: US 9,416,566 B2
(45) Date of Patent: Aug. 16, 2016

(54) DOOR LATCH WITH FAST UNLOCK

(75) Inventors: Kris Tomaszewski, Newmarket (CA); Francesco Cumbo, Pisa (IT)

(73) Assignee: Magna Closures Inc., Newmarket (CA)

( * ) Notice: Subject to any disclaimer, the term of this patent is extended or adjusted under 35 U.S.C. 154(b) by 386 days.

(21) Appl. No.: 12/682,096

(22) PCT Filed: Oct. 10, 2008

(86) PCT No.: PCT/CA2008/001807

§ 371 (c)(1), (2), (4) Date: Apr. 8, 2010

(87) PCT Pub. No.: WO2009/046539

PCT Pub. Date: Apr. 16, 2009

(65) Prior Publication Data

US 2010/0207400 A1 Aug. 19, 2010

Related U.S. Application Data

(60) Provisional application No. 60/978,800, filed on Oct. 10, 2007, provisional application No. 61/075,379, filed on Jun. 25, 2008.

(51) Int. Cl.

| | |
|---|---|
| ***E05C 3/06*** | (2006.01) |
| ***E05B 85/00*** | (2014.01) |
| ***E05B 81/06*** | (2014.01) |
| ***E05B 81/16*** | (2014.01) |

(Continued)

(52) U.S. Cl.

CPC ..... *E05B 85/01* (2013.01); *E05B 81/06* (2013.01); *E05B 81/16* (2013.01); *E05B 81/34* (2013.01); *E05B 15/004* (2013.01); *Y10T 292/108* (2015.04); *Y10T 292/1076* (2015.04)

(58) Field of Classification Search

CPC ..... E05B 81/14; E05B 85/26; E05B 81/06; E05B 81/20; E05B 81/90; E05B 81/26; E05B 81/02; E05B 81/01; E05C 19/184; E05C 19/18; E05C 19/186

USPC ..... 292/201, 216, DIG. 23, 288, 339, 1, 292/336.3, 196

See application file for complete search history.

(56) References Cited

U.S. PATENT DOCUMENTS 3,583,742 A * 6/1971 Kwasiborski, Jr. ... E05B 85/243 292/216
3,602,019 A * 8/1971 Kazaoka ..... 70/264

(Continued)

FOREIGN PATENT DOCUMENTS

CA WO 2006099730 A1 * 9/2006 ..... E05B 77/26
GB 2416187 A 1/2006

(Continued)

*Primary Examiner* — Kristina Fulton
*Assistant Examiner* — Nathan Cumar
(74) *Attorney, Agent, or Firm* — Dickinson Wright PLLC

(57) ABSTRACT

In one aspect, the invention is directed to a closure latch for a vehicle door. The closure latch includes a ratchet movable between an open position and a closed position, a first door release lever operatively connected to the ratchet, a second door release lever, and a lock lever movable along a lock lever path including a first lock lever position wherein the second door release lever is operatively disconnected from the first door release lever, a second lock lever position wherein the lock lever operatively connects the second door release lever to the first door release lever, and a third lock lever position wherein the lock lever carries out an additional function.

17 Claims, 6 Drawing Sheets

(51) Int. Cl.
*E05B 81/34* (2014.01)
*E05B 15/00* (2006.01)

(56) References Cited

U.S. PATENT DOCUMENTS 3,666,308 A * 5/1972 Bonnaud ..... 292/336.3
3,695,662 A * 10/1972 Ploughman ..... 292/216
4,093,289 A * 6/1978 Inabayashi ..... E05B 81/25 292/201
4,269,440 A * 5/1981 Gelhard ..... E05B 81/06 292/201
4,290,634 A * 9/1981 Gelhard ..... 292/201
4,502,718 A * 3/1985 Sasaki ..... E05B 81/25 192/41 S
4,536,021 A * 8/1985 Mochida ..... E05B 77/12 292/201
4,575,138 A * 3/1986 Nakamura et al. ..... 292/216
4,778,206 A * 10/1988 Matsumoto ..... G07C 9/00182 292/201
4,779,912 A * 10/1988 Ikeda ..... E05B 81/25 292/201
4,932,690 A * 6/1990 Kleefeldt ..... E05B 81/06 292/201
4,978,155 A * 12/1990 Kobayashi ..... E05B 81/25 292/201
4,986,579 A * 1/1991 Ishikawa ..... E05B 81/20 292/201
5,005,392 A * 4/1991 Shibata ..... E05B 81/72 292/201
5,154,457 A * 10/1992 Watanabe ..... E05B 85/243 292/201
5,438,855 A * 8/1995 Ikeda ..... 70/279.1
5,516,167 A * 5/1996 Hayakawa et al. ..... 292/337
5,762,383 A * 6/1998 Gomi ..... 292/216
5,844,470 A 12/1998 Garnault et al.
6,148,651 A * 11/2000 Roncin ..... 70/264
6,328,353 B1 12/2001 Barczynski et al.
6,343,817 B1 * 2/2002 Watanabe ..... 292/216
6,494,505 B2 * 12/2002 Kobayashi et al. ..... 292/201
6,705,140 B1 * 3/2004 Dimig et al. ..... 70/277
6,737,758 B2 5/2004 Weyerstall et al.
6,824,177 B1 11/2004 Nass et al.
6,880,866 B2 4/2005 Tomaszewski et al.
6,948,745 B2 * 9/2005 Chevalier ..... 292/201
7,213,428 B2 * 5/2007 Harada et al. ..... 70/256
7,264,283 B2 * 9/2007 Stoof et al. ..... 292/216
7,270,029 B1 9/2007 Papanikolaou et al.
7,399,010 B2 7/2008 Hunt et al.
8,029,028 B2 * 10/2011 Akizuki et al. ..... 292/201
8,141,916 B2 * 3/2012 Tomaszewski et al. ..... 292/201
2001/0024041 A1 * 9/2001 Barczynski ..... E05B 77/26 292/216
2002/0050721 A1 * 5/2002 Kobayashi et al. ..... 292/216
2003/0074935 A1 4/2003 Baukholt
2005/0099017 A1 * 5/2005 Yoneyama et al. ..... 292/216
2006/0103145 A1 * 5/2006 Ottolini et al. ..... 292/216
2006/0125244 A1 * 6/2006 Mochizuki et al. ..... 292/201
2007/0152455 A1 7/2007 Ko et al.
2009/0243309 A1 * 10/2009 Takahashi et al. ..... 292/201
2010/0207400 A1 * 8/2010 Tomaszewski et al. ..... 292/196

FOREIGN PATENT DOCUMENTS

WO WO 00/79079 A1 6/2000
WO WO 2006099730 A1 * 9/2006

* cited by examiner

DOOR LATCH WITH FAST UNLOCK

CROSS-REFERENCE TO RELATED APPLICATIONS

This applicaiton is a National Stage of International Application No. PCT/CA2008/01807, filed on Oct. 10, 2008, which claims priority to and the benefit of U.S. Provisional Applicaiton No. 60/978,800 filed Oct. 10, 2007 and U.S. Provisional Application No. 61/075,379 filed Jun. 25, 2008. The entire disclosure of each of the above applications is incorporated herein by reference.

FIELD OF THE INVENTION

The present invention relates to a closure latch for a vehicle door, and more particularly to a closure latch for a vehicle door equipped with a passive entry feature.

BACKGROUND OF THE INVENTION

Passive entry systems for vehicles are provided on some vehicles to permit a vehicle user who is in possession of the vehicle key to simply pull the door handle and open the door without the need to introduce the key into a keyhole in the door. The key (more particularly, the key fob) is equipped with an electronic device that communicates with the vehicle's on-board control system to authenticate the user. When the user pulls the door handle to indicate that he/she wishes entry into the vehicle, it would be advantageous for the vehicle to unlock the door relatively quickly so that he/she does not have to wait an unduly long time before being permitted to open the door.

SUMMARY OF THE INVENTION

In one aspect, the invention is directed to a closure latch for a vehicle door. The closure latch includes a ratchet movable between an open position and a closed position, a first door release lever operatively connected to the ratchet, a second door release lever, and a lock lever movable along a lock lever path including a first lock lever position wherein the second door release lever is operatively disconnected from the first door release lever, a second lock lever position wherein the lock lever operatively connects the second door release lever to the first door release lever, and a third lock lever position wherein the lock lever carries out an additional function.

BRIEF DESCRIPTION OF THE DRAWINGS

The present invention will now be described by way of example only with reference to the attached drawings, in which.

DETAILED DESCRIPTION OF THE INVENTION

Figure 1A:
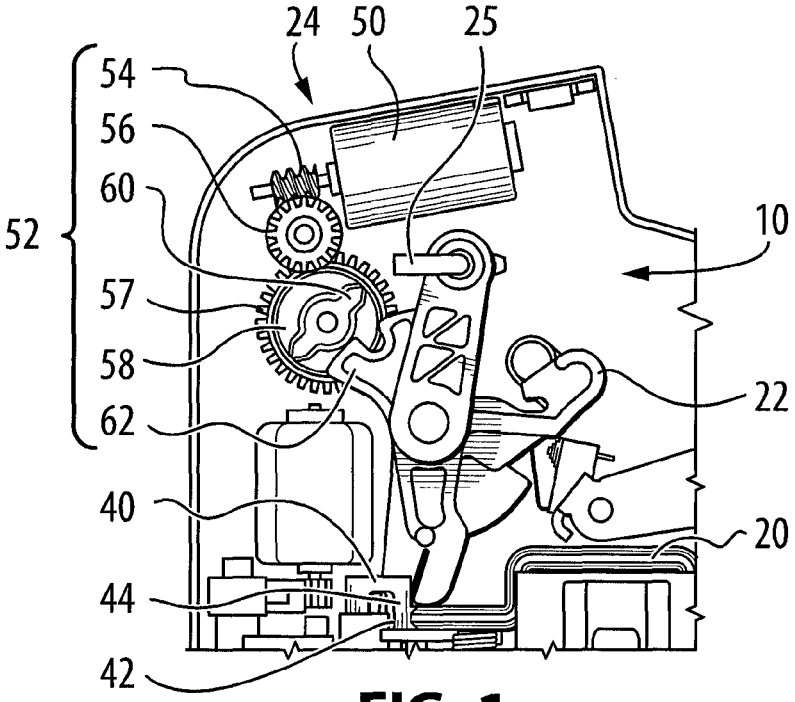
FIG. 1*a* is an elevation view of a portion of a closure latch for a vehicle door in accordance with an embodiment of the present invention, showing a lock lever in a first position.
Figure 1B:
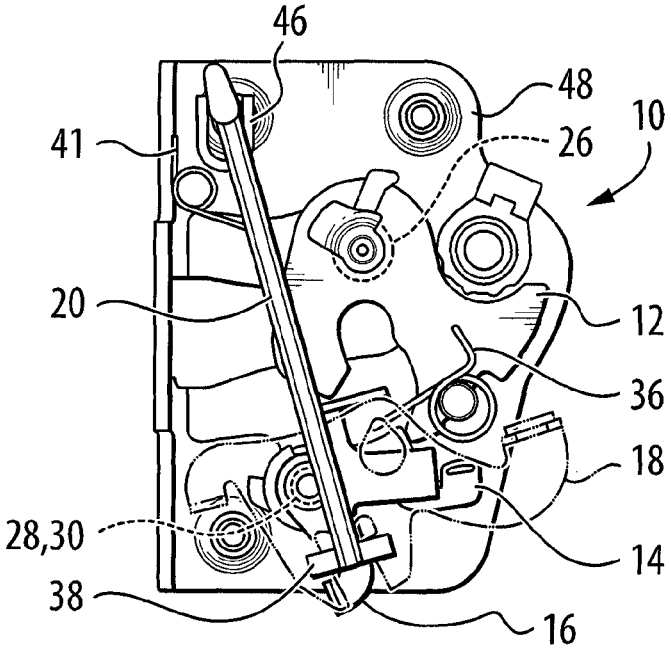
FIG. 1*b* is a plan view of another portion of the vehicle latch shown in FIG. 1*a* with some components shown as transparent for greater clarity.

Reference is made to FIGS. 1*a* and 1*b*, which show portions of a closure latch 10 for a door (not shown) of a vehicle (not shown), in accordance with an embodiment of the present invention.

Figure 1C:
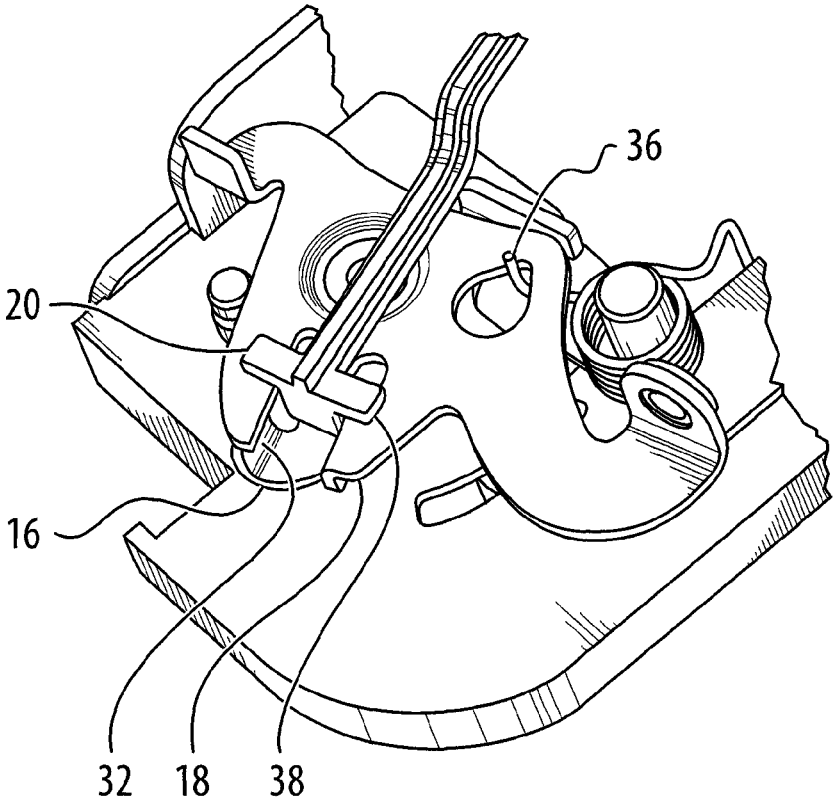
FIG. 1*c* is a magnified perspective view of a portion of the closure latch shown in FIG. 1*b;*
Figure 1D:
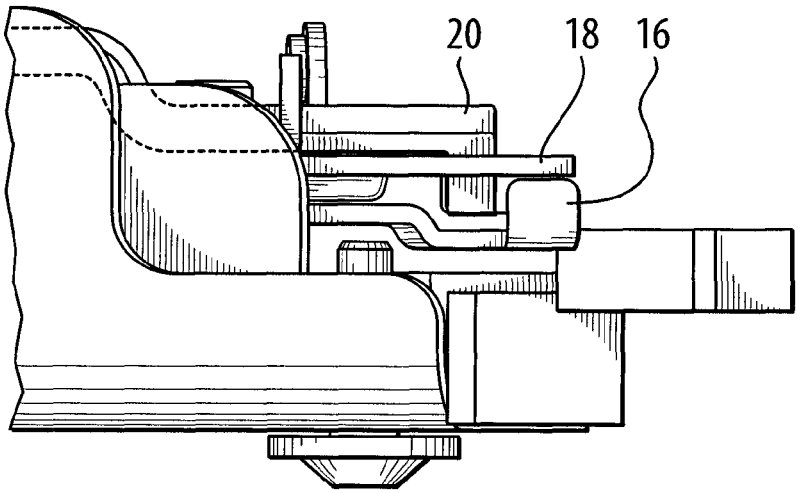
FIG. 1*d* is an elevation view of the portion of the closure latch shown in FIG. 1*c;*

The closure latch 10 includes a ratchet 12 (FIG. 1*b*), a pawl 14 (FIG. 1*b*), a first door release lever 16 (FIG. 1*c*), a second door release lever 18 (FIG. 1*b*), a lock link 20 (FIG. 1*b*), a lock lever 22 (FIG. 1*a*), a lock lever actuator 24 (FIG. 1*a*) and a lock knob assembly 25 (a small portion of which is shown in FIG. 1*a*).

Referring to FIG. 1*b*, the ratchet 12 is movable between a closed position (FIG. 1*b*) wherein the ratchet 12 retains a striker (not shown) mounted on the body (not shown) of the vehicle and an open position wherein the ratchet 12 is unengaged with the striker. A ratchet biasing member 26 such as a suitable spring may be provided to bias the ratchet 12 towards the open position.

The pawl 14 is movable between a ratchet locking position (FIG. 1*b*) wherein the pawl 14 holds the ratchet 12 in the closed position, and a release position wherein the pawl 14 permits the ratchet 12 to move to its open position. A pawl biasing member 28 such as a suitable spring may be provided to bias the pawl 14 towards the ratchet locking position.

Figure 1E:
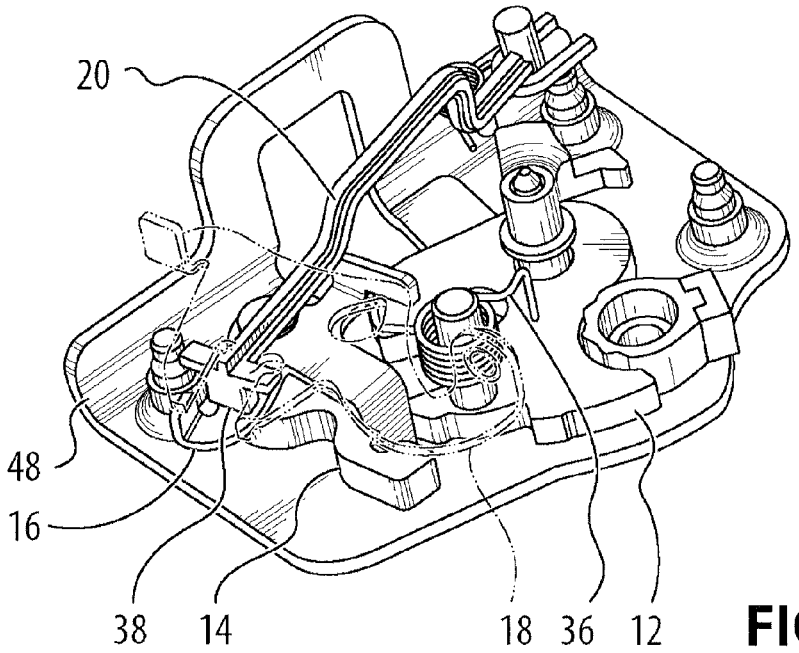
FIG. 1*e* is another magnified perspective view of the portion of the closure latch shown in FIG. 1*b* with some components shown as transparent for greater clarity.

The first door release lever 16 is operatively connected to the ratchet 12 for movement from the closed position to the open position. The first door release lever 16 may be operatively connected to the ratchet 12 in any suitable way, such as by direct mechanical engagement (See FIG. 1*e*). The first door release lever 16 may be movable from a rest position to a door release position (not shown) wherein it moves the pawl 14 to the release position (not shown) so that the ratchet 12 can be moved from the closed position to the open position under the urging of the ratchet biasing member 26.

A first door release lever biasing member 30, such as a suitable spring, may be provided to bias the first door release lever 16 towards its rest position. Instead of having a first door release lever biasing member 30 that is dedicated solely to moving the first door release lever 16 to its rest position, it is possible for the pawl 14 to move the first door release lever 16 to its rest position, during movement of the pawl 14 to its ratchet locking position under the urging of the pawl biasing member 28. Thus, the pawl biasing member 28 may act as a first door release lever biasing member 30 as shown in FIG. 1*b*.

The first door release lever 16 (FIG. 1*c*) has a first lock link engagement surface 32 which is configured to be engaged by the lock link 20.

Figure 2A:
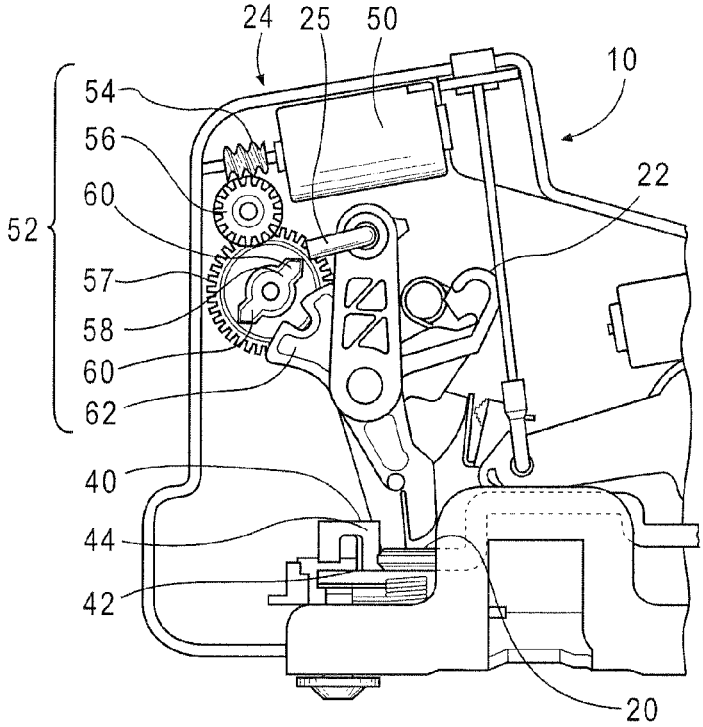
FIG. 2*a* is an elevation view of the closure latch shown in FIG. 1*a*, showing the lock lever in a second position.
Figure 2B:
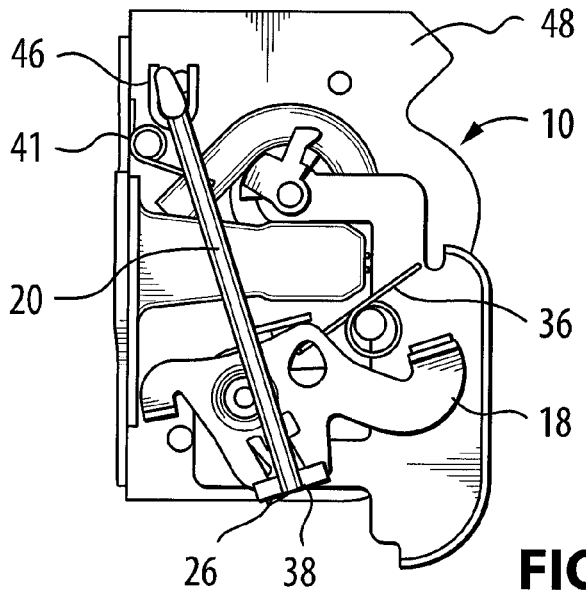
FIG. 2*b* is a plan view of the closure latch shown in FIG. 2*a;*
Figure 2C:
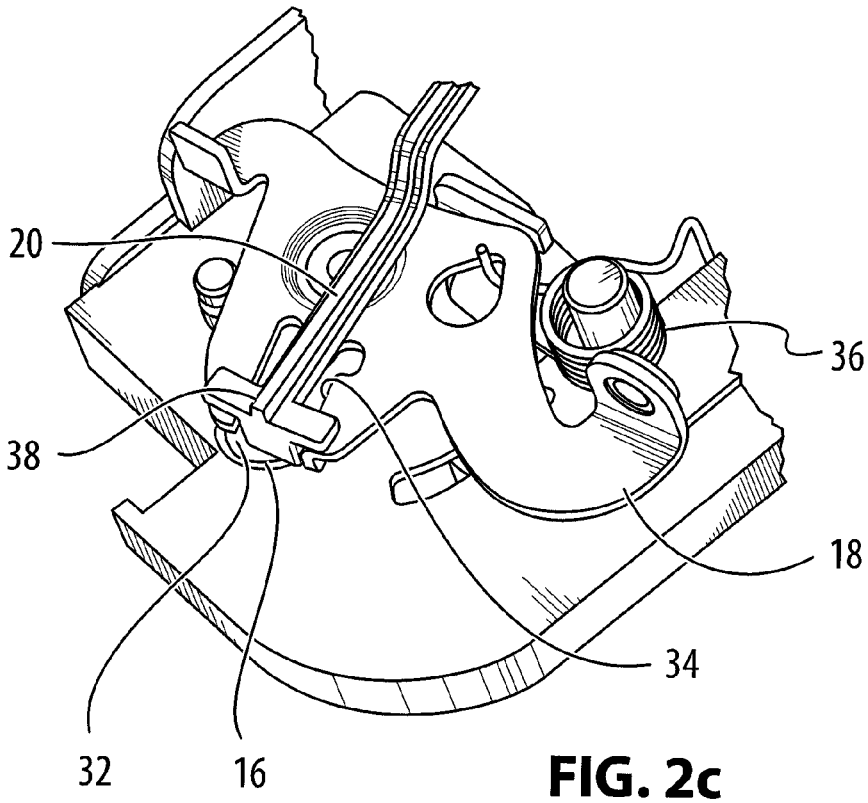
FIG. 2*c* is a magnified perspective view of a portion of the closure latch shown in FIG. 2*b;*
Figure 2D:
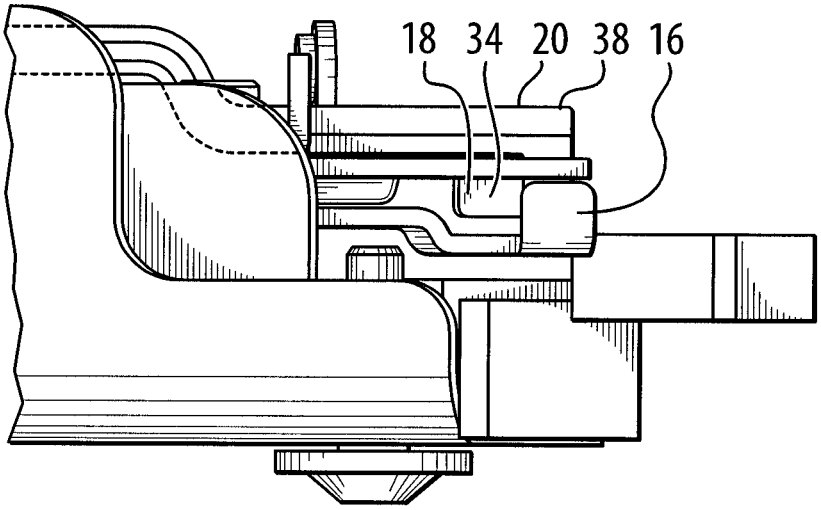
FIG. 2*d* is an elevation view of the portion of the closure latch shown in FIG. 2*c;*
Figure 2E:
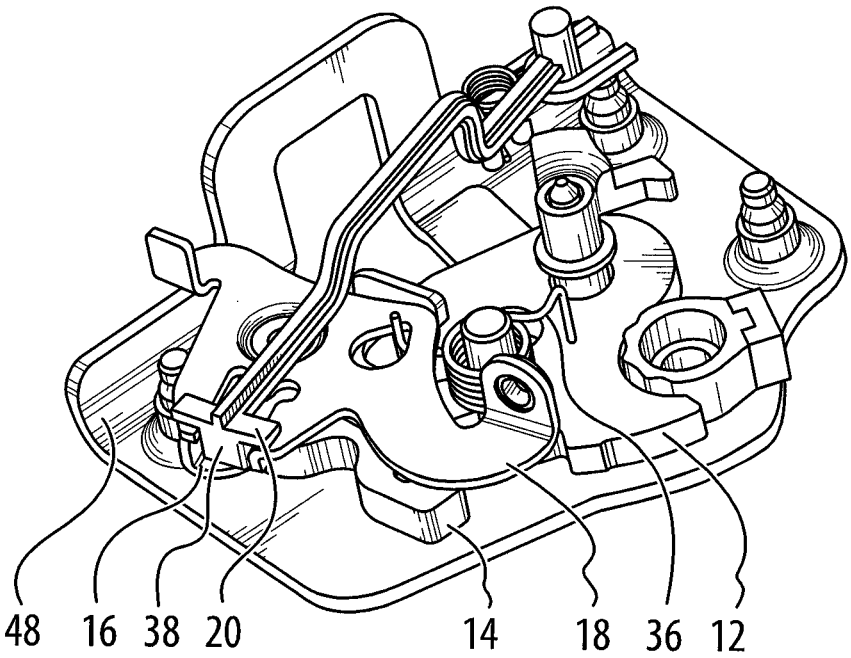
FIG. 2*e* is another magnified perspective view of the portion of the closure latch shown in FIG. 2*b* with some components shown as transparent for greater clarity.

The second door release lever 18 (FIG. 2*c*) is operatively connectable to the first door release lever 16. The second door release lever 16 may be operatively connectable to the first door release lever 16 in any suitable way, such as through the lock link 20. The second door release lever 18 includes a second lock link engagement surface 34 that is positioned to engage the lock link 20. The second door release lever 18 may be movable from a rest position (FIG. 1*c*) to a door release position (not shown), which is described further below.

A second door release lever biasing member 36, such as a suitable spring, may be provided to bias the second door release lever 18 towards its rest position.

The second door release lever 18 may be moved from its rest position to its door release position by one or more means, such as by movement of an outer door handle (not shown) on the outside of the vehicle door (not shown).

The lock link 20 may be movable between a first lock link position 20 (FIGS. 1*a*-1*e*) wherein the lock link 20 is disengaged from the first door release lever, and a second lock link position (FIGS. 2*a*-2*e*) wherein the second door release lever 18 is operatively connected to the first door release lever 16 through the lock link 20. More specifically, when a person pulls the outside door handle the second door release lever 18 is moved from its rest position to its door release position and moves a first end 38 of the lock link 20 with it. If the lock link 20 is in the first position (FIGS. 1*a*-1*e*) and the person pulling the vehicle door handle is not in possession of an electronic vehicle key, then the first end 38 of the lock link 20 will sweep past the first lock link engagement surface 32 during movement of the second door release lever 18 to its door release position. As a result, the first door release lever 16 will not be moved to its door release position and the ratchet 12 will remain in its closed position.

When the lock link 20 is in the second position (FIGS. 2*a*-2*e*) and the second door release lever 18 is moved from its rest position to its door release position, the first end 38 of the lock link 20 is positioned to engage the first lock link engagement surface 32 and will move the first door release lever 16 to its door release position (not shown) thereby moving the pawl 14 and ratchet 12 to open the vehicle door.

The lock link 20 may be biased towards the second lock link position (FIG. 2*b*), by any suitable means, such as by a suitable spring 41.

The second end of the lock link 20 is shown at 40 in FIG. 1*a*. At the second end 40, the lock link 20 has a guide pin 42 and a lock lever engagement member 44. The guide pin 42 engages a guide channel 46 that is fixedly connected to a latch housing member 48. The guide channel 46 and the guide pin 42 together guide the movement of the lock link 20 between its first and second positions.

The guide pin 42 is rotatable within the guide channel 46 (FIG. 1*b*). This permits the lock link 20 to pivot as necessary during movement of the second door release lever 18 between its rest position and its door release position.

Figure 3:
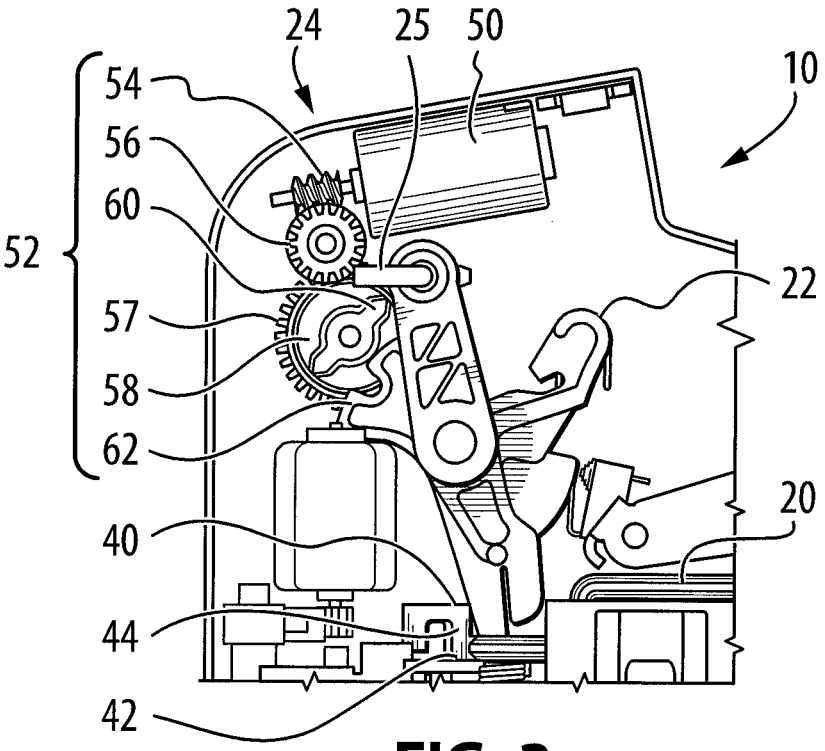
FIG. 3 is an elevation view of the closure latch shown in FIG. 1*a*, showing the lock lever in a third position.

The lock lever engagement member 44 is engageable by the lock lever 22 (FIG. 1*a*). The lock lever 22 is movable between a first position (FIG. 1*a*), a second position (FIG. 2*a*) and a third position (FIG. 3). In the first position, the lock lever 22 holds the lock link 20 in the first lock link position (FIGS. 1*a*-1*e*). Additionally, when the lock lever 22 is in the first position, the lock knob assembly 25 is in a locked lock knob assembly position. When the lock lever 22 is in the second position (FIG. 2*a*), it permits the lock link 20 to move to the second lock link position (FIG. 2*b*) under the urging of the lock link biasing member 41 (FIG. 2*b*), thereby providing an operative connection from the second door release lever 18 to the first door release lever 16. Additionally, when the lock lever 22 is in the second position, the lock knob assembly 25 may be moved from the locked lock knob assembly position to an intermediate position (FIG. 2*a*) on the way to an unlocked lock knob assembly position (FIG. 3).

As the lock lever 22 moves away from the second position towards the third position, it may disengage from the lock link 20. The movement of the lock lever 22 to the third position causes the lock knob assembly 25 to move to the unlocked lock knob assembly position.

Rotation of the lock lever 22 from the first position towards the third position is in an unlocking direction. Rotation of the lock lever 22 from the third position towards the first position is in a locking direction.

The lock lever actuator 24 moves the lock lever 22 along the lock lever path between the first and third positions. Referring to FIG. 1*a*, the lock lever actuator 24 includes a motor 50 and a linkage 52 that operative connects the motor 50 to the lock lever 22. The linkage 52 may include a worm gear 54 driven directly by the motor 50, a first spur gear 56 driven by the worm gear 54, a second spur gear 57 driven by the first spur gear 56 and a lobed member 58 with at least one lobe 60 integrally connected to the second spur gear 57. A lobe receiving member 62 may be included as part of the lock lever 22 for receiving the lobe 60 and being driven thereby.

The movement of the lock knob assembly 25 between its locked and unlocked positions may require significantly more torque than the movement of the lock link 20 between its first and second positions. As a result, there is a relationship between the strength (and therefore cost) of the motor 50, the effective torque increase that takes place in the linkage 54 and the time required to carry out the movement of the lock knob assembly 25 between its locked and unlocked positions.

When the vehicle is locked and a person who is in possession of a proximity-actuated key (not shown) lifts the outside door handle of the vehicle, the initial movement of the outside door handle instructs the vehicle's on-board electronics to actuate the motor 50. The motor 50 causes the rotation of the lock lever 22 from the first lock lever position (FIG. 1*a*) through the second lock lever position (FIG. 2*a*) to the third lock lever position (FIG. 3). The movement of the lock lever 22 from the first lock lever position to the second lock lever position causes the lock link 20 to move from the first lock link position to the second lock link position thereby operatively connecting the second door release lever 18 to the first door release lever 16. This process of actuating the motor 50 until the second door release lever 18 is operatively connected to the first door release lever 16 preferably takes place within a selected period of time, which may be, for example, less than 50 milliseconds.

Because the lock link 20 is disengageable from the lock lever 22 (eg. during movement of the lock lever 22 between the second and third lock lever positions) the movement of the lock link 20 and the movement of the lock knob assembly 25 are independent of one another. By having the movements of the lock link 20 and the lock knob assembly 25 be independent from one another, the movement of the lock link 20 to its second position can be effected quickly so as to reduce the time to unlock the vehicle door, while the movement of the lock knob assembly 25 can remain longer so as to not require an undesirably strong (and therefore relatively expensive) motor 50. Preferably, the time required to unlock the vehicle door can be short enough so as to permit a person to open the door in one continuous motion without having to pause midway to permit the door to unlock.

To lock the vehicle door, the motor 50 is rotated so that the lock lever 22 moves from the third lock lever position through the second lock lever position to the first lock lever position. Movement of the lock lever 22 from the third lock lever position to the second lock lever position moves the lock knob assembly 25 partway from the unlocked lock knob assembly position towards the locked lock knob assembly position.

When the lock lever 22 is in the second lock lever position it has reengaged with the lock link 20. It will be understood that the point at which the lock link 20 is engaged by the lock lever 22 does not necessarily have to correspond to the point at which the lock link 20 operatively connects the second door release lever 18 to the first door release lever 16. In other words, the point at which the lock link 20 is engaged by the lock lever 22 may be somewhere suitable between the second and third lock lever positions.

Movement of the lock lever 22 from the second lock lever position to the first lock lever position moves the lock link 20 from the second lock link position to the first lock link position, thereby operatively disconnecting the second door release lever 18 from the first door release lever 16.

It has been shown for the lock lever 22 to control the operative connection between the second and first door release levers 18 and 16 via the lock link 20. It is alternatively possible however, for the lock lever 22 to control the operative connection between the second and first door release levers 18 and 16 in some other way. For example, an alternative embodiment may omit the lock link and an arm on the lock lever 22 itself may be selectively positionable in between the second and first door release levers 18 and 16 based on the position of the lock lever.

While the above description constitutes a plurality of embodiments of the present invention, it will be appreciated that the present invention is susceptible to further modification and change without departing from the fair meaning of the accompanying claims.

The invention claimed is:

1. A latch for use with a striker, an outside door handle, and a lock knob assembly within a vehicle, the latch comprising:

a ratchet movable between a closed position in which the striker is retained within the latch and an open position in which the ratchet is able to release the striker from the ratchet, a lock lever movable along a lock lever path from a first locked position to a second unlocked position, wherein the lock lever operatively engages the ratchet and allows the ratchet to move to the open position when the lock lever moves to the second unlocked position, the lock lever causes movement of the lock knob assembly to an unlocked lock knob assembly position when the lock lever moves to the second unlocked position, and the lock knob assembly reaches the unlocked lock knob assembly position after the lock lever operatively engages the ratchet, wherein actuation of the outside door handle causes the ratchet to open and release the striker from the latch when the ratchet is operatively engaged by the lock lever, and wherein the ratchet remains closed upon actuation of the door handle if the ratchet is disengaged from the lock lever.

2. The latch of claim 1 wherein as the lock lever follows the lock lever path in an opposite second direction the lock knob assembly moves to a locked position.

3. The latch of claim 1 further comprising a motorized lock lever actuator that is operatively connected to the lock lever.

4. The latch of claim 3 wherein the motorized lock lever actuator is configured to move the lock lever from the first locked position to the second unlocked position in less than about 50 milliseconds.

5. The latch of claim 1 further comprising a door release lever that is operatively connected to the outside door handle and is operatively connectable to the ratchet, wherein the first locked position is a first lock lever position wherein the door release lever is operatively disconnected from the ratchet in the first lock lever position, the second unlocked position is a second lock lever position wherein the lock lever operatively connects the door release lever and the ratchet, and the lock lever moves from the first lock lever position to the second lock lever position and to a third lock lever position, the second lock lever position is between the first lock lever position and the third lock lever position, and the lock lever causes the movement of the lock knob assembly to the unlocked lock knob assembly position in the third lock lever position.

6. A closure latch for a vehicle door, comprising:

a ratchet movable between an open position and a closed position;

a door release lever operatively connected to the ratchet;

a lock lever movable along a lock lever path including a first lock lever position wherein the door release lever is operatively disconnected from the lock lever, a second lock lever position wherein the lock lever is operatively connected to the door release lever, and a third lock lever position wherein the lock lever carries out an additional function; and a lock link engaging the lock lever and operatively connected to the door release lever, wherein at a selected point along a portion of the lock lever path between the second lock lever position and the third lock lever position, the lock lever disengages from the lock link.

7. The latch of claim 5 further comprising a motorized lock lever actuator that is operatively connected to the lock lever, and wherein the motorized lock lever actuator is controllable to move the lock lever from the first lock lever position to the third lock lever position through the second lock lever position in response to partial actuation of the outside door handle on a vehicle door on the vehicle.

8. The latch of claim 1 further comprising a first door release lever for operative connection to the outside door handle and operatively connectable to the ratchet, a second door release lever for operative connection to an inside door release lever, and a lock link that is movable by the lock lever between a first lock link position wherein the lock link is disengaged from the first door release lever and a second lock link position wherein the second door release lever is operatively connected to the first door release lever through the lock link.

9. The latch of claim 8 wherein the lock link is biased toward the second lock link position.

10. The latch of claim 1 further comprising a pawl movable between a ratchet locking position wherein the pawl holds the ratchet in the closed position, and a ratchet release position wherein the pawl permits movement of the ratchet to the open position.

11. The latch of claim 10 wherein the pawl is biased towards the ratchet locking position.

12. A latch for use with a striker, an outside door handle, and a lock knob assembly within a vehicle, the latch comprising:

a ratchet having a closed position in which the striker is retained within the latch, and an open position is which the ratchet is able to release the striker from the ratchet, a motor operatively connected to a door release lever and causing operative engagement of the door release lever and the ratchet in response to authentication of a user and actuation of the outside door handle from a disengaged position, the motor operatively connected to a lock knob assembly and causing movement of the lock knob assembly to an unlocked position, wherein when the ratchet is operatively engaged with the door release lever, actuation of the outside door handle causes the ratchet to open and release a striker from the latch, and wherein when the ratchet is disengaged from the door release lever, the ratchet remains closed upon actuation of the door handle, and wherein the lock knob assembly reaches the unlocked position after the door release lever operatively engages the ratchet.

13. The latch of claim 1 including a lock lever actuator for moving the lock lever to the second unlocked position upon actuation of the outside door handle only after authentication of the user.

14. The latch of claim 1, wherein the lock knob assembly moves toward the unlocked lock knob assembly position after the lock lever operatively engages the ratchet.

15. The latch of 12, wherein the lock knob assembly moves toward the unlocked position after the door release lever operatively engages the ratchet.

16. A latch for a vehicle door, comprising:

a lock knob assembly movable between a locked position and an unlocked position, a ratchet movable between a closed position in which a striker is retained within the ratchet and an open position in which the ratchet is able to release the striker, a first door release lever movable between a rest position wherein the first door release lever is operatively disconnected from the ratchet to prevent the ratchet from moving to the open position and a door release position wherein the first door release lever is operatively connected to the ratchet to allow the ratchet to move to the open position, a second door release lever movable between a rest position and a door release position and operatively connected to the first door release lever for moving the first door release lever from the rest position to the door release position, a lock link operatively connected to the second door release lever, the lock link movable between a first position wherein the lock link is disengaged from the first door release lever and a second position wherein the lock link operatively connects the first door release lever and the second door release lever, a lock lever moveable between a first position and a second position and a third position, wherein the lock lever holds the lock link in the first position and holds the lock knob assembly in the locked position when the lock lever is in the first position, the lock lever engages the lock link while permitting the lock link to move to the second position and permitting the lock knob assembly to move toward the unlocked position when the lock lever is in the second position, and the lock lever disengages the lock link and allows the lock knob assembly to move to the unlocked position when the lock lever is in the third position, and wherein after the lock lever disengages the lock link and before the lock knob assembly reaches the unlocked position, the lock link reaches the second position and operatively connects the first door release lever to the second door release lever to allow the ratchet to move to its open position.

17. The latch of claim 16, wherein the lock lever moves from the first position to the third position in response to authentication of a user of the vehicle and actuation of an outside door handle of the vehicle.

* * * * *